US005164018A

United States Patent [19]

Barcelona, Jr.

[11] Patent Number: 5,164,018

[45] Date of Patent: Nov. 17, 1992

[54] WATER-SPOT REMOVER CONTAINING HYDROFLUORIC ACID, AMMONIUM FLUORIDE, AND AN ALCOHOL

[76] Inventor: Russell L. Barcelona, Jr., 16014 Manchester Ave., Baton Rouge, La. 70816

[21] Appl. No.: 853,280

[22] Filed: Mar. 18, 1992

[51] Int. Cl.[5] ..... B08B 3/08; C11D 7/08; C11D 7/10; C11D 7/50

[52] U.S. Cl. ..... 134/28; 134/3; 134/42; 252/79.3; 252/142; 252/143; 252/DIG. 10

[58] Field of Search ..... 252/79.3, 142, 143, 252/DIG. 10; 134/3, 28

[56] References Cited

U.S. PATENT DOCUMENTS

| | | | |
|---|---|---|---|
| 2,278,257 | 3/1942 | Gallagher | 252/79.3 |
| 2,399,134 | 4/1946 | Miller | 252/143 |
| 2,558,013 | 6/1951 | Staubly | 252/143 |
| 2,714,094 | 7/1955 | McNally | 252/541 |
| 2,878,188 | 3/1959 | Callahan | 252/136 |
| 3,150,007 | 9/1964 | Kovachy | 134/4 |
| 3,630,931 | 12/1971 | Salomone | 252/142 |
| 4,181,623 | 1/1980 | Dillarstone | 252/143 |
| 4,198,262 | 4/1980 | Gay | 134/3 |
| 4,332,649 | 6/1982 | Sälzle | 204/98 |
| 4,477,364 | 10/1984 | Garcia | 252/142 |
| 4,517,106 | 5/1985 | Hopkins | 252/79.4 |
| 4,545,918 | 10/1985 | Pralus | 252/142 |
| 4,960,459 | 10/1990 | Poole et al. | 419/63 |
| 4,970,014 | 11/1990 | Garcia | 252/79.3 |

FOREIGN PATENT DOCUMENTS

| | | | |
|---|---|---|---|
| 52-74604 | 7/1977 | Japan | 252/143 |
| 697290 | 9/1953 | United Kingdom | 252/DIG. 10 |

*Primary Examiner*—Dennis Albrecht
*Attorney, Agent, or Firm*—Reginald F. Roberts, Jr.

[57] ABSTRACT

A chemical composition which, when applied to water spots on a glass surface such as a windshield, removes the water spots from the windshield or other glass surface. The composition includes (a) an alcohol such as isopropyl alcohol with one to three carbon atoms per molecule, (b) hydrofluoric acid, (c) water, and optionally (d) ammonium fluoride.

2 Claims, No Drawings

WATER-SPOT REMOVER CONTAINING HYDROFLUORIC ACID, AMMONIUM FLUORIDE, AND AN ALCOHOL

BACKGROUND OF THE INVENTION

The present invention relates to a chemical composition. More particularly, the present invention relates to a chemical composition for removing water spots from glass surfaces.

Water spots are found quite commonly and frequently on the outer surface of windows of automotive vehicles. These spots interfere with visibility, and distract the driver operating the motor vehicle. They are resistant to scrubbing with soap and water.

For these reasons, a need exists for a method of removing water spots from the windshields of automotive vehicles, and from glass surfaces in general. The present invention provides a chemical composition which satisfies this need.

SUMMARY OF THE INVENTION

In general, the present invention provides a chemical composition which, when applied to water spots on a glass surface, removes the water spots. A first embodiment of the composition comprises (a) an alcohol containing from one to three carbon atoms per molecule, (b) hydrofluoric acid, and (c) water. A second embodiment of the composition comprises (a) an alcohol containing from one to three carbon atoms per molecule, (b) hydrofluoric acid, (c) an ammonium salt of hydrofluoric acid, and (d) water. A third embodiment of the composition consists essentially of (a) an alcohol containing from one to three carbon atoms per molecule (b) hydrofluoric acid, and (c) water. A fourth embodiment of the composition consists essentially of (a) an alcohol containing from one to three carbon atoms per molecule, (b) hydrofluoric acid, (c) ammonium fluoride, and (d) water. A fifth embodiment of the invention comprises applying the above solutions to water spots on a glass surface, thereby removing the water spots. The ammonium salt of hydrofluori acid may be ammonium fluoride, $NH_4F$; ammonium bifluoride, $NH_5F_2$; or a mixture thereof.

The preferred method for removing a water spot from a glass surface comprises the following steps: (a) applying to the water spot on the glass surface a chemical composition including ($a_1$) an alcohol containing from one to three carbon atoms per molecule, ($a_2$) hydrofluoric acid, ($a_3$) ammonium fluoride, and ($a_4$) water; (b) allowing the composition to evaporate to dryness; and (c) flushing the glass surface with water. The glass surface is then beneficially and optionally wiped dry. Step (b) leaves a residue on the glass surface which has the appearance of a hazy film.

Less preferred methods comprise using the above sequence of steps with a composition which does not include ammonium fluoride.

DETAILED DESCRIPTION OF THE INVENTION

More specifically, the four alcohols which may be used to formulate the composition of the present invention are methyl, ethyl, normal propyl and isopropyl alcohols. Of these four alcohols, isopropyl alcohol is preferred.

The chemical composition which constitutes the present invention is a homogeneous solution useful for removing water spots from a glass surface by applying the solution thereto. A preferred use of the invention is for removing water spots from the outer surfaces of the windshields of automotive vehicles.

In a preferred embodiment, the solution contains from about five to about fifteen percent of the alcohol, from about one to about three percent of hydrofluoric acid, from about two to about six percent of ammonium fluoride, and from about seventy-six to about ninety-two percent water. The hydrofluoric acid is expressed as HF, and all concentrations are expressed as percent by weight.

Even more preferably, the solution contains from about eight to about twelve percent alcohol, from about one and one-half to about two and one-half percent hydrofluoric acid, from about three to about five percent ammonium fluoride, and from about eighty to about eighty-eight percent water.

Most preferably, the solution contains from about nine to about eleven percent alcohol, from about 1.8 to about 2.2 percent hydrofluoric acid, from about three and one-half to about four and one-half percent ammonium fluoride, and from about eighty-two to about eighty-six percent water.

In an alternative and less-preferred embodiment, the solution contains from about five to about fifteen percent alcohol, from about one to about three percent hydrofluoric acid, and from about eighty-two to about ninety-four percent water. More preferably, the solution contains from about eight to about twelve percent alcohol, from about one and one-half to about two and one-half percent hydrofluoric acid, and from about eighty-five to about ninety-one percent water. Most preferably, the solution contains from about nine to about eleven percent alcohol, from about 1.8 to about 2.2 percent hydrofluoric acid, and from about eighty-six to about ninety percent water.

A chemical composition made in accordance with the principles of the present invention is beneficially prepared by mixing (a) a mixture of water and isopropyl alcohol, (b) a water solution of hydrofluoric acid, and (c) a water solution of ammonia.

A convenient commercial source of isopropyl alcohol is "rubbing alcohol compound," which usually contains from about sixty to about eighty percent isopropyl alcohol and from about twenty to about forty percent water by volume. A second source is a liquid marketed under the name "Ethyl Rubbing Alcohol—70%" by Cumberland Manufacturing Co., Smyrna, Tenn.

A convenient commercial source of hydrofluoric acid is a solution sold under the trade name "Coil Master Foaming Condenser" by Crow Marketing & Distribution, Dallas, Tex.

A convenient commercial source of ammonium hydroxide (a water solution of ammonia) is a liquid marketed as "Aqua Ammonia" by National Ammonia Co./-Bower Ammonia & Chemical Co., Philadelphia, Pa.

The following examples are intended to illustrate but not to limit the scope of the present invention.

EXAMPLE I

Solution A was prepared to contain approximately ten percent of isopropyl alcohol, two percent hydrofluoric acid, four percent ammonium fluoride, and eighty-four percent water by weight. The pH of Solution A was about three. Solution A was applied to the outer surface of an automobile windows having water spots.

The affected area was allowed to dry, then flushed with water and wiped dry. This treatment effectively removed the water spots from the windshield.

EXAMPLE II

Solution B was prepared to contain approximately twelve percent isopropyl alcohol, three percent hydrofluoric acid, and eighty-five percent water by weight. Solution B was applied to the outer surface of an automobile windshield having water spots. The affected area was allowed to dry, then flushed with water and wiped dry. This treatment effectively removed the spots from the windshield.

I claim:

1. A method for removing a water spot from a glass surface, the method comprising the steps of:

(a) applying to the water spot on the glass surface a chemical composition consisting essentially of ($a_1$) from about five to about fifteen percent isopropyl alcohol, ($a_2$) from about one to about three percent hydrofluoric acid, and ($a_3$) from about eighty-two to about ninety-four percent water by weight;

(b) allowing the composition to evaporate to dryness; and (c) flushing the glass surface with water.

2. A method for removing a water spot from a glass surface, the method comprising the steps of:

(a) applying to the water spot on the glass surface a chemical composition consisting essentially of ($a_1$) from about nine to about eleven percent isopropyl alcohol, ($a_2$) from about one and one-half to about two and one-half percent hydrofluoric acid, ($a_3$) from about three to about five percent of an ammonium salt of hydrofluoric acid, and ($a_4$) from about eighty-one to about eighty-seven percent water by weight;

(b) allowing the composition to evaporate to dryness; and (c) flushing the glass surface with water.

* * * * *